US008055161B2

(12) United States Patent
Kim

(10) Patent No.: US 8,055,161 B2
(45) Date of Patent: Nov. 8, 2011

(54) IMAGE FORMING APPARATUS, DEVELOPING UNIT THEREOF AND METHOD FOR CONTROLLING DEVELOPING UNIT

(75) Inventor: Dae-Ho Kim, Euiwang-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 999 days.

(21) Appl. No.: 11/954,701

(22) Filed: Dec. 12, 2007

(65) Prior Publication Data

US 2008/0192080 A1 Aug. 14, 2008

(30) Foreign Application Priority Data

Feb. 13, 2007 (KR) ..... 10-2007-0014907

(51) Int. Cl.
*G03G 15/08* (2006.01)

(52) U.S. Cl. ..... 399/254; 399/256

(58) Field of Classification Search ..... 399/254–256, 399/258

See application file for complete search history.

(56) References Cited

FOREIGN PATENT DOCUMENTS

JP 2006-106114 4/2006

*Primary Examiner* — Hoang Ngo

(74) *Attorney, Agent, or Firm* — Stanzione & Kim, LLP

(57) ABSTRACT

An image forming apparatus, a developing unit thereof and a method of controlling the developing unit. The image forming apparatus includes a photosensitive body on which an electrostatic latent image is formed, a light scanning unit which scans a beam onto the photosensitive body, a developing unit which includes a housing having an agitating space and a supply space, the agitating space and the supply space communicating with each other through two gates to circulate a developer, an agitating auger rotatably mounted in the agitating space to transfer the developer, a supply auger rotatably mounted in the supply space to transfer the developer, and a magnetic roller which receives the developer by the supply auger and adheres the developer to the photosensitive body, a rotation control unit which controls rotation of the agitating auger and the supply auger, and a transfer unit which transfers a visible image formed on the photosensitive body onto a printing medium. When the developer is concentrated on any one of two gates, one of the augers, which is positioned on a downstream side of the gate on which the developer is concentrated, temporarily stops rotating by the rotation control unit, and the developer concentrated on the gate is transferred from the gate by the other one of the augers, which is positioned on an upstream side of the gate on which the developer is concentrated.

22 Claims, 9 Drawing Sheets

IMAGE FORMING APPARATUS, DEVELOPING UNIT THEREOF AND METHOD FOR CONTROLLING DEVELOPING UNIT

CROSS-REFERENCE TO RELATED APPLICATIONS

This application claims the benefit of Korean Patent Application No. 2007-0014907, filed on Feb. 13, 2007 in the Korean Intellectual Property Office, the disclosure of which is incorporated herein in its entirety by reference.

BACKGROUND OF THE INVENTION

1. Field of the Invention

The present general inventive concept relates to an image forming apparatus, and more particularly, to an image forming apparatus that uses a developer, a developing unit thereof and a method of controlling the developing unit.

2. Description of the Related Art

An image forming apparatus is an apparatus that prints a black and white image or a color image on a printing medium, e.g., paper, according to an inputted image signal, for example, a laser printer, an ink-jet printer, a copying machine, a multi-function printer, a fax machine, etc. An image forming apparatus is classified as an electrophotographic type in which a beam is scanned onto a photosensitive body to form an electrostatic latent image and a toner is adhered to the electrostatic latent image to transfer the same onto a printing medium, or an ink-jet type in which a liquid type ink is ejected onto a surface of a printing medium according to an image signal.

The electrophotographic image forming apparatus is configured such that a surface of a photosensitive body is charged with a predetermined electric potential, a beam is scanned onto the photosensitive body to form an electrostatic latent image due to electric potential difference, and a developer, i.e., a toner is adhered to the electrostatic latent image to form a visible image. The visible image formed on the photosensitive body is transferred onto the printing medium, and is fixed to the surface of the printing medium by applying heat and pressure to the printing medium.

The electrophotographic image forming apparatus uses a unitary developer which is composed of an insulating toner or a conductive toner, or a binary developer which is composed of a toner and a magnetic carrier. The electrophotographic development using the unitary developer is achieved such that toner particles are charged by friction between the toner particles or friction with a charging member and are transferred onto a photosensitive body through a developing roller. The electrophotographic development using the binary developer is achieved such that a magnetic carrier and a non-magnetic toner of a synthetic resin material are mixed in the appropriate ratio, toner particles are charged when mixed with carrier particles, and the toner particles and the carrier particles are transferred onto the photosensitive body through a magnetic roller.

The development using the binary developer has the merit that a toner charging efficiency is high, a lifespan of the toner is long, and deterioration of toner quality during the charge is low, resulting in an increase in image quality.

A developing unit of an image forming apparatus using the binary developer includes a housing which has a space to agitate the toner, a magnetic roller which receives the agitated toner and attaches the same to a photosensitive body, and a pair of augers which are mounted in the housing to agitate the toner. The housing is provided with a toner supply port, through which the toner is supplied from a toner supply container mounted to the exterior of the housing. A space inside the housing is sectioned into an agitating space in which the toner is mixed with the carrier, and a supply space from which the toner mixed with the carrier is supplied to the magnetic roller. One auger is rotatably mounted in the agitating space, and another auger is rotatably mounted in the supply space. The agitating space and the supply space can be communicated with each other by two gates which are provided at both sides of the inside of the housing.

While a new toner supplied into the agitating space of the housing is transferred toward one side of the housing by the auger mounted in the agitating space, the toner is mixed with the carrier and simultaneously charged. The developer mixed in the agitating space is transferred into the supply space through the gate provided at one side in the housing, and is adhered uniformly to the surface of the magnetic roller while being transferred toward the other side of the housing by the auger mounted in the supply space. The developer transferred to the other side of the housing without being supplied to the magnetic roller is transferred again into the agitating space through the gate provided at the other side of the housing.

However, in the above conventional developing unit of the image forming apparatus, the developer may be concentrated on one of the gates due to the tilting during conveyance or installation, or the irregular operation of the augers. In this case, because the developer cannot be transferred smoothly through the gates, a transfer pressure of the developer at the gate increases and a torque of the rotating auger increases excessively, which may cause breakage of the components like the auger or the housing.

SUMMARY OF THE INVENTION

The present general inventive concept provides an image forming apparatus that is capable of smoothly solving the concentration of a developer and preventing the breakage of components when the developer circulating in an agitating space and a supply space in a developing unit by augers mounted in the spaces is concentrated on gates which connect the agitating space and the supply space.

The present general inventive concept provides a developing unit of the above image forming apparatus.

The present general inventive concept provides a method of controlling the developing unit.

Additional aspects and/or advantages of the general inventive concept will be set forth in part in the description which follows and, in part, will be obvious from the description, or may be learned by practice of the general inventive concept.

The foregoing and/or other aspects and utilities of the present general inventive concept may be achieved by providing an image forming apparatus including a photosensitive body on which an electrostatic latent image is formed, a light scanning unit which scans a beam onto the photosensitive body, a developing unit which includes a housing having an agitating space and a supply space, the agitating space and the supply space communicating with each other through two gates to circulate a developer, an agitating auger rotatably mounted in the agitating space to transfer the developer, a supply auger rotatably mounted in the supply space to transfer the developer, and a magnetic roller which receives the developer by the supply auger and attaches the developer to the photosensitive body, a rotation control unit which controls rotation of the agitating auger and the supply auger, and a transfer unit which transfers a visible image formed on the photosensitive body onto a printing medium. When the developer is concentrated on any one of two gates, one of the agitating auger and the supply auger, which is positioned on a downstream side of the gates on which the developer is concentrated, temporarily stops rotating by the rotation control unit, and the developer concentrated on the gate is transferred from the gate by the other one of the agitating auger and the supply auger, which is positioned on an upstream side of the gates on which the developer is concentrated.

The agitating auger and the supply auger may respectively have rotating shafts, the rotating shafts being respectively provided with gears connected to an external driving source, and the rotation control unit may be configured as torque limiters which are mounted between the rotating shafts of the agitating auger and the supply auger and the gears. If a torque applied to the rotating shafts exceeds a predetermined value, the torque limiters interrupt power transmission between the rotating shafts and the gears.

Each of the torque limiters may include an outer ring which is coupled to each of the gears, and an inner ring which is coupled to each of the rotating shafts of the agitating auger and the supply auger and is in contact with an inner surface of the outer ring, the inner ring being able to slip on the inner surface of the outer ring. If a torque applied to the inner ring exceeds a predetermined value, the inner ring slips on the inner surface of the outer ring, and the inner ring and the rotating shaft stop rotating.

Alternatively, the agitating auger and the supply auger may respectively have rotating shafts, the rotating shafts being respectively coupled with gears connected to an external driving source, and the rotation control unit may include auger driving parts which transmit driving power to the rotating shafts of the agitating auger and the supply auger, and a control device which controls the auger driving parts.

The image forming apparatus may further include a sensor to sense concentration of the developer in the housing.

The foregoing and/or other aspects and utilities of the present general inventive concept may also be achieved by providing a developing unit of an image forming apparatus, including a housing which has an agitating space and a supply space, the agitating space and the supply space communicating with each other through two gates to circulate a developer, an agitating auger which is rotatably mounted in the agitating space to transfer the developer, a supply auger which is rotatably mounted in the supply space to transfer the developer, a magnetic roller which receives the developer by the supply auger and adheres the developer to a photosensitive body; and a rotation control unit which controls rotation of the agitating auger and the supply auger. When the developer is concentrated on any one of two gates, one of the agitating auger and the supply auger, which is positioned on a downstream side of the gates on which the developer is concentrated, temporarily stops rotating by the rotation control unit, and the developer concentrated on the gate is transferred from the gate by the other one of the agitating auger and the supply auger, which is positioned on an upstream side of the gates on which the developer is concentrated.

The foregoing and/or other aspects and utilities of the present general inventive concept may also be achieved by providing a method of controlling a developing unit of an image forming apparatus, including determining whether a developer contained in a housing having an agitating space and a supply space is concentrated on any one of two gates which connect the agitating space and the supply space to circulate the developer; if the developer is concentrated on any one of two gates in the housing, stopping rotation of one of an agitating auger and a supply auger rotatably mounted in the agitating space and the supply space, which is positioned on a downstream side of the gates on which the developer is concentrated, to transfer the developer from the gate on which the developer is concentrated by the other one of the agitating auger and the supply auger, which is positioned on a upstream side of the gates on which the developer is concentrated; determining whether the concentration of the developer on the gate is solved; and if the concentration of the developer on the gate is solved, rotating again one of the agitating auger and the supply auger, which stops rotating.

The foregoing and/or other aspects and utilities of the present general inventive concept may also be achieved by providing a developing unit usable with an image forming apparatus, including a housing an agitating space and a supply space to contain a developer, a supply auger disposed in the supply space to selectively rotate according to an amount of a developer, and an agitating auger disposed in the agitating space to selectively rotate according to an amount of the developer.

One of the supply auger and the agitating auger may be stationary with respect to the other one of the supply auger and the agitating auger according to a density representing the amount of the developer in one of the supply space and the agitating space.

One of the supply auger and the agitating auger may idle, and the other one of the supply auger and the agitating auger may rotate with respect to the one of the supply auger and the agitating auger.

The developer may move between the supply space and the agitating space according to a selectively rotating one of the supply auger and the agitating auger.

One of the supply auger and the agitating auger may be stationary when the other one of the supply auger and the agitating auger rotates, such that the developer moves between the supply space and the agitating space.

The housing may include a partition to divide an inside space into the agitating space and the supply space, and to form a first gate and a second gate to connect the agitating space and the supply space such that the developer moves between the agitating space and the supply space.

One of the supply auger and the agitating auger may selectively stop according to an amount of the developer accumulating in one of the first gate and the second gate, such that the other one of the supply auger and the agitating auger rotates to move the developer between the first gate and the second gate.

The first gate and the second gate may be spaced apart from a center of an inside of the housing, and lengths of the supply auger and the agitating auger may be longer than a distance between the first gate and the second gate.

The developing unit may further include a supply gear to receive an external rotating force, a supply shaft connected to the supply auger to selectively idle with respect to the gear according to a torque applied to the supply shaft, an agitating gear to receive an external rotating force, and an agitating shaft connected to the supply auger to selectively idle with respect to the gear according to a torque applied to the agitating shaft.

The developing unit may further include a torque limiter disposed between the supply gear and the supply shaft to allow the supply shaft to idle with respect to the supply auger.

The developing unit may further include a torque limiter disposed between the agitating gear and the agitating shaft to allow the agitating shaft to idle with respect to the agitating auger.

The developing unit may further include a first torque limiter disposed between the supply gear and the supply shaft, and having a first torque limiting value to allow the supply shaft to idle with respect to the supply auger, and a second torque limiter disposed between the agitating gear and the agitating shaft, and having a second torque limiting value to allow the agitating shaft to idle with respect to the agitating auger.

The first torque limiting value and the second torque limiting value may be set such that at least one of the supply auger and the agitating auger idle with respect to the other one of the supply auger and the agitating auger.

The first torque limiter may include a first inner ring and a first outer ring, and the second torque limiter may include a second inner ring and a second outer ring.

The developing unit may further include a roller disposed in the supply space to transfer the developer from the supply auger to a photosensitive body, and one of the supply auger and the agitating auger may selectively stop rotating according to the amount of the developer in one of the supply space and the agitating space when the roller supplies the developer from the supply space to the photosensitive body.

The foregoing and/or other aspects and utilities of the present general inventive concept may also be achieved by providing an image forming apparatus including a photosensitive body, and a developing unit to supply a developer to the photosensitive body, and including a housing an agitating space and a supply space to contain a developer, a supply auger unit having a supply auger disposed in the supply space to selectively rotate according to an amount of a developer, and an agitating auger unit having an agitating auger disposed in the agitating space to selectively rotate according to an amount of the developer.

BRIEF DESCRIPTION OF THE DRAWINGS

These and/or other aspects and utilities of the exemplary embodiments of the general inventive concept will become apparent and more readily appreciated from the following description of the embodiments, taken in conjunction with the accompanying drawings, of which.

DETAILED DESCRIPTION OF THE PREFERRED EMBODIMENTS

Figure 1:
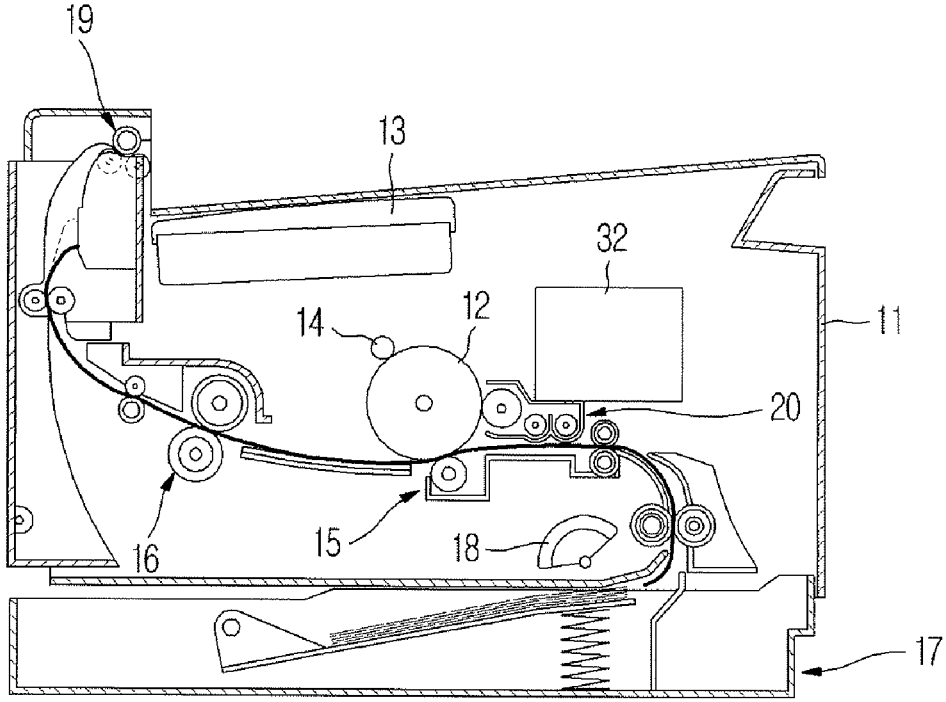
FIG. 1 is a side-sectional view schematically illustrating an image forming apparatus in accordance with an exemplary embodiment of the present general inventive concept.

Reference will now be made in detail to exemplary embodiments of the present general inventive concept, examples of which are illustrated in the accompanying drawings, wherein like reference numerals refer to like elements throughout. The embodiments are described below to explain the present general inventive concept by referring to the figures.

As illustrated in FIG. 1, an image forming apparatus according to an exemplary embodiment of the present general inventive concept includes a main body 11 which forms an external appearance, a photosensitive body 12 on which an electrostatic latent image is formed, a light scanning unit 13 which scans a beam onto the photosensitive body 12, a charge unit 14 which charges the photosensitive body 12 with a predetermined electric potential, a developing unit 20 which supplies (attaches or transfers) a toner to the photosensitive body 12 to develop the electrostatic latent image into a visible image, a transfer unit 15 which transfers the visible image formed on the photosensitive body 12 onto a printing medium, and a fixing unit 16 which fuses the visible image formed by the powder type toner to the surface of the printing medium by applying heat and pressure to the printing medium.

The image forming apparatus further includes a printing medium supply unit 17 which is removably mounted below the main body 11 to supply the printing medium, a pickup device 18 which picks up the printing medium loaded on the printing medium supply unit 17 sheet by sheet, and a printing medium discharge unit 19 which discharges the printing medium on which the image has been completely printed to the outside of the main body 11.

If a printing operation of the image forming apparatus of the present embodiment is initiated, the pickup device 18 picks up the printing medium loaded on the printing medium supply device 17 sheet by sheet, and feeds the same to the developing unit 20. The light scanning unit 13 scans a beam onto the surface of the photosensitive body 12, which is charged with a predetermined electric potential, according to an image signal to form an electrostatic latent image on the surface of the photosensitive body 12. Toner particles are adhered to the electrostatic latent image region on the surface of the photosensitive body 12 to form a powder type visible image. The visible image is transferred onto the surface of the printing medium by the transfer unit 15. The visible image transferred onto the printing medium is fused and fixed to the surface of the printing medium by receiving heat and pressure while passing through the fixing unit 16. The printing medium having passed the fixing unit 16 is discharged to the outside of the main body 11 by the printing medium discharge unit 19.

Since all the components except for the developing unit 20 of the present embodiment may be similar to components of a typical image forming apparatus, the detailed explanation thereof will be omitted.

The image forming apparatus according to the present embodiment adopts the development method using a binary developer which is composed of a toner and a magnetic carrier. The developing unit 20 forming the visible image on the photosensitive body 12 includes a housing 21 which has a space to agitate the toner and the carrier, an agitating auger 23 and a supply auger 24 which are rotatably mounted in the housing 21, and a magnetic roller 29 which receives the developer by the supply auger 24 and adheres the developer to the surface of the photosensitive body 12.

Figure 2:
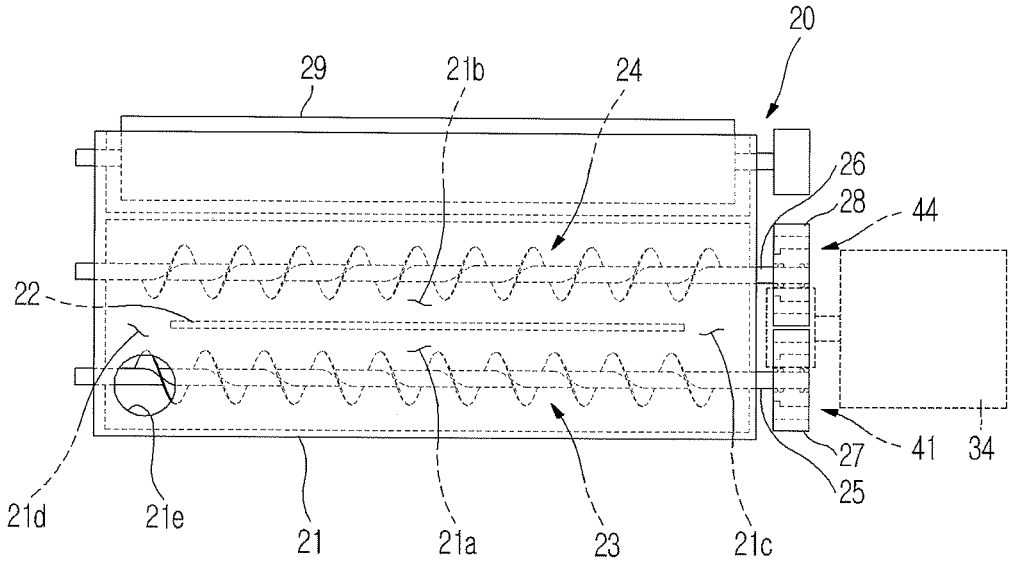
FIG. 2 is a plan view schematically illustrating a developing unit of the image forming apparatus of FIG. 1 in accordance with an exemplary embodiment of the present general inventive concept.

As illustrated in FIG. 2, a space inside the housing 21 is sectioned into an agitating space 21*a*, in which the developer is agitated, and a supply space 21*b*, from which the agitated developer is supplied to the magnetic roller 29, by a partition wall 22. The partition wall 22 has a length shorter than the space inside the housing 21 so that both side portions inside the housing 21 are opened. The both side portions inside the housing 21 are respectively provided with a first gate 21*c* and a second gate 21*d* that connect the agitating space 21*a* and the supply space 21*b*. The housing 21 is provided with a toner supply port 21*e* to supply the toner therein, at a position of an upper portion approximate to the second gate 21*d*. The toner in a toner supply container 32 (see FIG. 1) is supplied into the housing 21 through the toner supply port 21*e*.

The agitating auger 23 is rotatably mounted in the agitating space 21*a*, and the supply auger 24 is rotatably mounted in the supply space 21*b*. The agitating auger 23 rotates by receiving driving power from an external driving source 34 to transfer a new toner supplied through the toner supply port 21*e* and the developer fed through the second gate 21*d* toward the first gate 21*c*. The toner transferred by the agitating auger 23 is mixed with the carrier and charged in the agitating space 21*a*. The developer transferred to the first gate 21*c* is pushed by the agitating auger 23 to be transferred into the supply space 21*b* through the first gate 21*c*.

The supply auger 24 rotates by receiving the driving power from the external driving source 34, and transfers the developer transferred through the first gate 21*c* to the second gate 21*d*. A portion of the developer transferred by the supply auger 24 in the supply space 21*b* is adhered to the magnetic roller 29. Also while the developer is transferred by the supply auger 24 in the supply space 21*b*, the mixing and charge of the toner is achieved as the same as in the agitating space 21*a*. The developer transferred to the second gate 21*d* in the supply space 21*b* is pushed by the supply auger 24, and is transferred again into the agitating space 21*a* through the second gate 21*d*.

The external driving source 34 may have a shaft and a gear connected to the shaft, and the gear of the external driving source 34 may be engaged with the gears 27 and 28. It is possible that the gear of the external driving source 34 is engaged with one of the gears 27 and 28, and that the one of the gears 27 and 28 is engaged with the other one of the gears 27 and 28. It is also possible that the external driving source 34 rotates the gears 27 and 28 in opposite directions, and that the external driving source 34 changes rotating directions of the gears 27 and 28.

As described above, the developer circulates in the housing 21 by the agitating auger 23 and the supply auger 24, from the agitating space 21*a* to the first gate 21*c*, from the first gate 21*c* to the supply space 21*b*, from the supply space 21*b* to the second gate 21*d*, and from the second gate 21*d* to the agitating space 21*a*.

Figure 3:
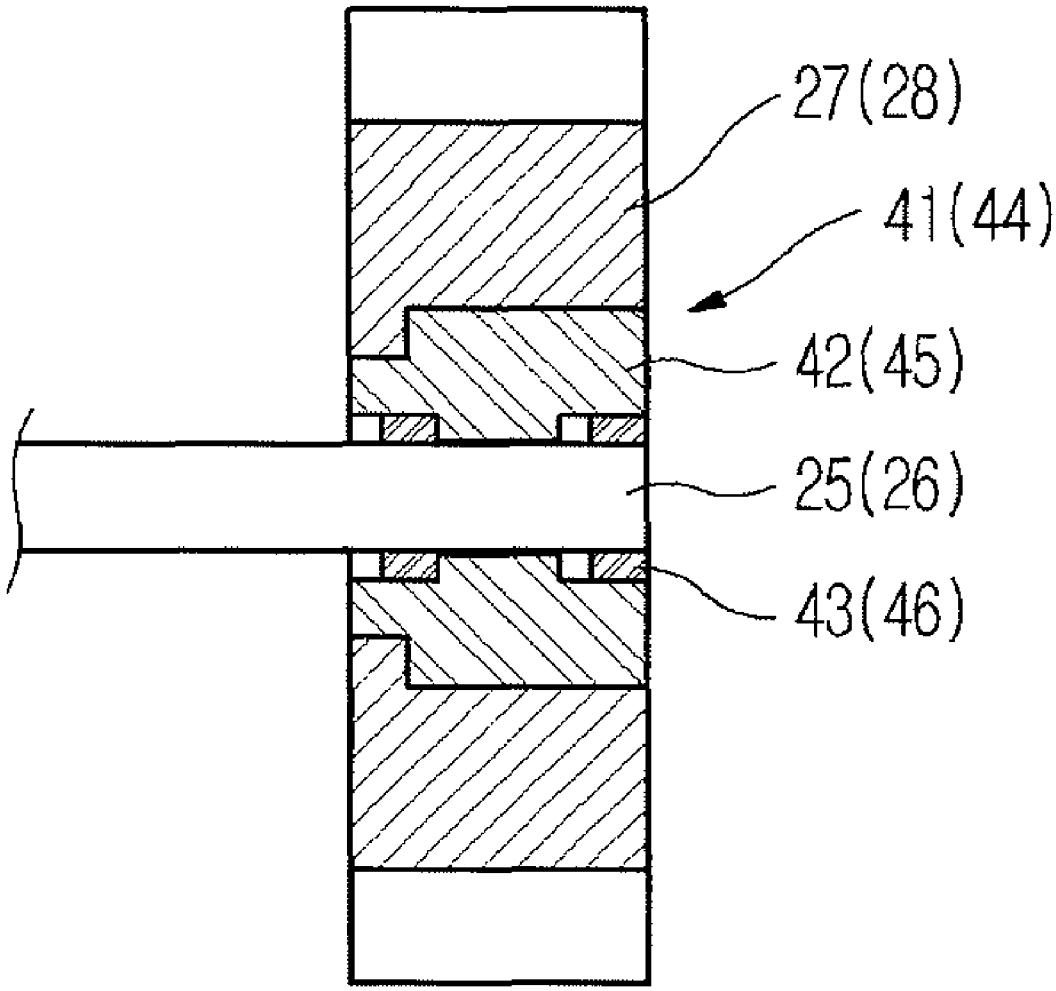
FIG. 3 is a sectional view illustrating the developing unit of FIG. 2 in accordance with an exemplary embodiment of the present general inventive concept.

As illustrated in FIGS. 2 and 3, the agitating auger 23 and the supply auger 24 have rotating shafts 25 and 26, respectively. Gears 27 and 28 are coupled to ends of the respective rotating shafts 25 and 26 to transmit the driving power of the external driving source 34 to the rotating shafts 25 and 26. Torque limiters 41 and 44 are mounted between the rotating shafts 25 and 26 of the respective augers 23 and 24 and the gears 27 and 28. Torque limiters 41 and 44 function as a rotation control means to control the rotation of the agitating auger 23 and the supply auger 24. When the developer is concentrated on either the first gate 21*c* or the second gate 21*d* in the housing 21, any one of the agitating auger 23 and the supply auger 24 stops rotating by the torque limiters 41 and 44.

As illustrated in FIG. 3, each torque limiter 41 (44) includes an outer ring 42 (45) which is coupled to the gear 27 (28), and an inner ring 43 (46) which is coupled to the rotating shaft 25 (26) and is in contact with the inner surface of the outer ring 42 (45). The inner ring 43 (46) can slip on the inner surface of the outer ring 42 (45). If a torque applied to the inner ring 43 (46) exceeds a predetermined value, the inner ring 43 (46) slips on the inner surface of the outer ring 42 (45) and stops rotating.

The torque limiters 41 and 44 may have a first torque limiting value and a second torque limiting value to be compared with the predetermined value. The first torque limiting value and the second torque limiting value are set such that at least one of the agitating auger 23 and the supply auger 24 stop rotating according to concentration of the developer in at least one of the agitating space 21*a*, the supply space 21*b*, the first gate 21*c*, and the second gate 21*d*.

Describing in detail, while each auger 23 (24) rotates by receiving the driving power from the external driving source 34 through the gear 27 (28), if the torque of the rotating auger 23 (24) exceeds the predetermined value due to resistance, the inner ring 43 (46) is identically applied with the excessive torque. If so, the inner ring 43 (46) slips on the inner surface of the outer ring 42 (45), and thus the inner ring 43 (46) and the auger 23 (24) stop rotating. Preferably, a magnitude of the torque creating the slip of the inner ring 43 (46) is set to a proper value which can prevent deformation or breakage of the components.

The resistance may represent the first torque limiting value and the second torque limiting value.

The agitating auger 23, the rotating shaft 25, the torque limiter 43, and the gear 27 may be referred to an agitating auger unit, and the supply auger 24, the rotating shaft 26, the torque limiter 44, and the gear 28 may be referred to a supply auger unit.

Hereinafter, an operation of the developing unit of the image forming apparatus according to the present embodiment will be described with reference to the annexed drawings.

Figure 4A:
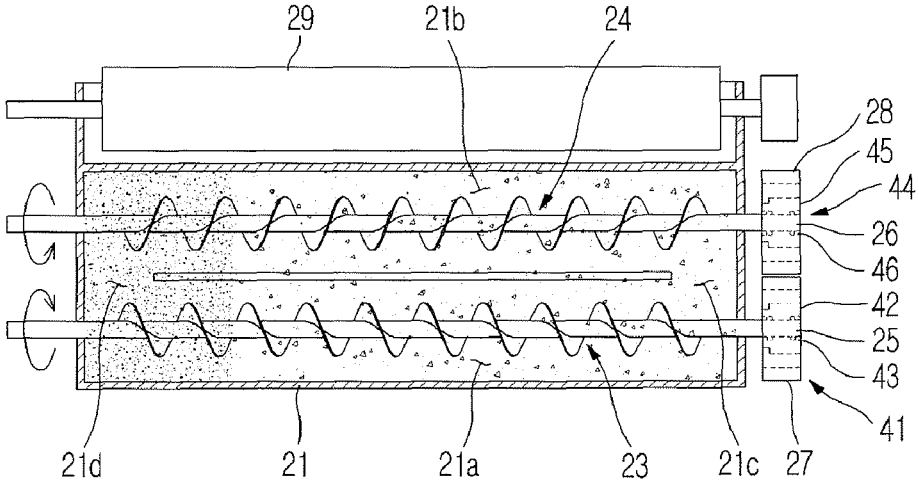
FIGS. 4A, 4B, 5A, and 5B are plan views illustrating an operation of the developing unit of the image forming apparatus of FIGS. 1-3 in accordance with an exemplary embodiment of the present general inventive concept.

As illustrated in FIG. 4A, while the agitating auger 23 and the supply auger 24 rotate by receiving the driving power from the external driving source 34, the developer may be concentrated on the second gate 21*d* in the housing 21. In this case, the developer cannot get smoothly out of the supply space 21*b* through the second gate 21*d* and stays in the supply space 21*b*. Accordingly, the rotational resistance and the torque of the supply auger 24 positioned on the downstream side of the second gate 21*d* increase, and thus the rotational load of the supply auger 24 increases.

If the torque of the supply auger 24 increases to an extent such that the torque applied to the inner ring 46 coupled to the rotating shaft 25 of the supply auger 24 exceeds the predetermined value, the inner ring 46 slips on the inner surface of the outer ring 45. Accordingly, the inner ring 46 and the supply auger 24 stop rotating, and the outer ring 45 coupled to the gear 28 idles. At this time, the agitating auger 23 continuously rotates to transfer the developer concentrated on the second gate 21*d* in the agitating space 21*a* toward the first gate 21*c*.

Figure 4B:
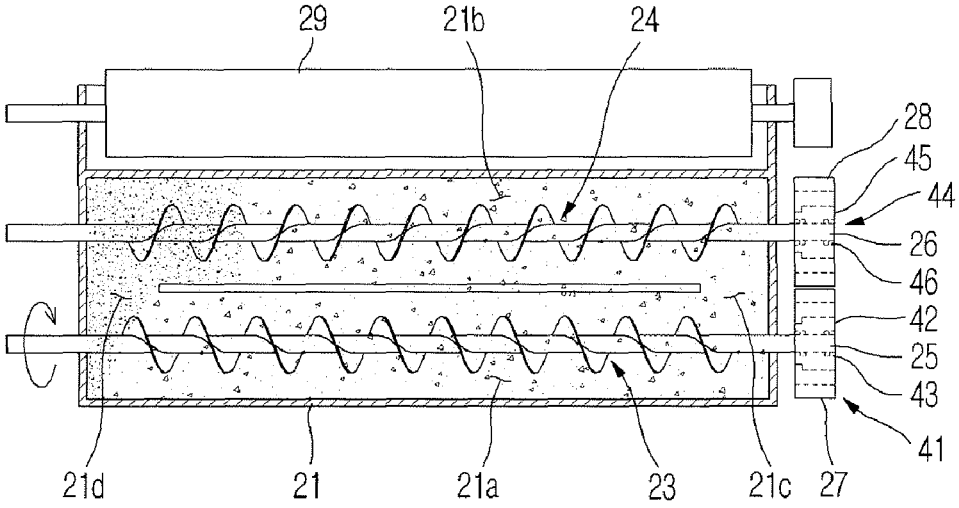

If the developer in the agitating space 21*a* is transferred toward the first gate 21*c*, as illustrated in FIG. 4B, the developer concentrated on the second gate 21*d* in the supply space 21*b* is transferred smoothly through the second gate 21*d*. Accordingly, the concentration phenomenon of the developer is solved. If the developer circulates again smoothly, the rotational resistance of the supply auger 24 decreases, and the torque of the supply auger 24 also decreases correspondingly thereto. If the torque of the supply auger 24 decreases to an extent such that the torque applied to the inner ring 46 of the torque limiter 44 drops below the predetermined value, the inner ring 46 rotates together with the outer ring 45, so that the supply auger 24 rotates again.

Figure 5A:
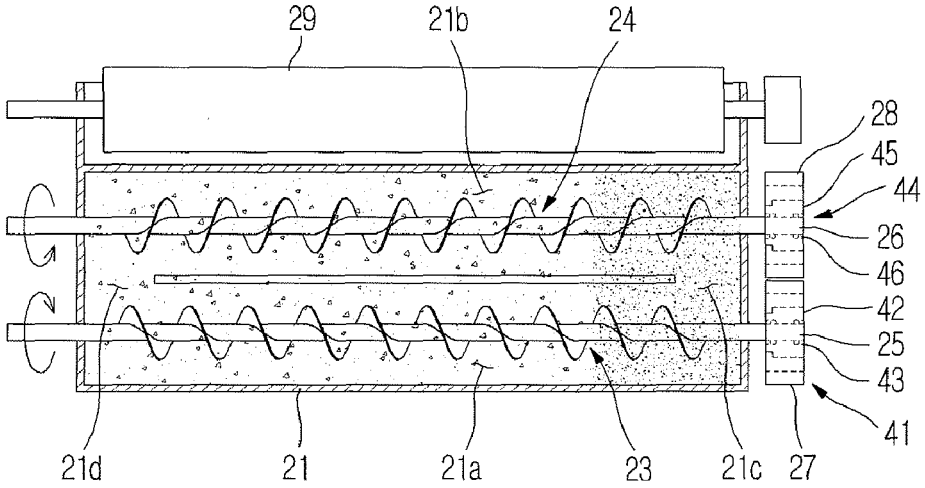

As illustrated in FIG. 5A, when the developer is concentrated on the first gate 21*c* between the agitating space 21*a* and the supply space 21*b*, the developer cannot be smoothly transferred into the supply space 21*b* from the agitating space 21*a* through the first gate 21*c*. At this time, the transfer pressure of the developer transferred through the first gate 21*c* increases, and the torque of the agitating auger 23 positioned on the downstream side of the first gate 21*c* increases. If the torque of the agitating auger 23 increases to an extent such that the torque applied to the inner ring 43 of the torque limiter 41 coupled to the agitating auger 23 exceeds the predetermined value, the inner ring 43 slips on the inner surface of the outer ring 42. Accordingly, the agitating auger 23 stops rotating, and the gear 27 transmitting the driving power to the agitating auger 23 idles.

Figure 5B:
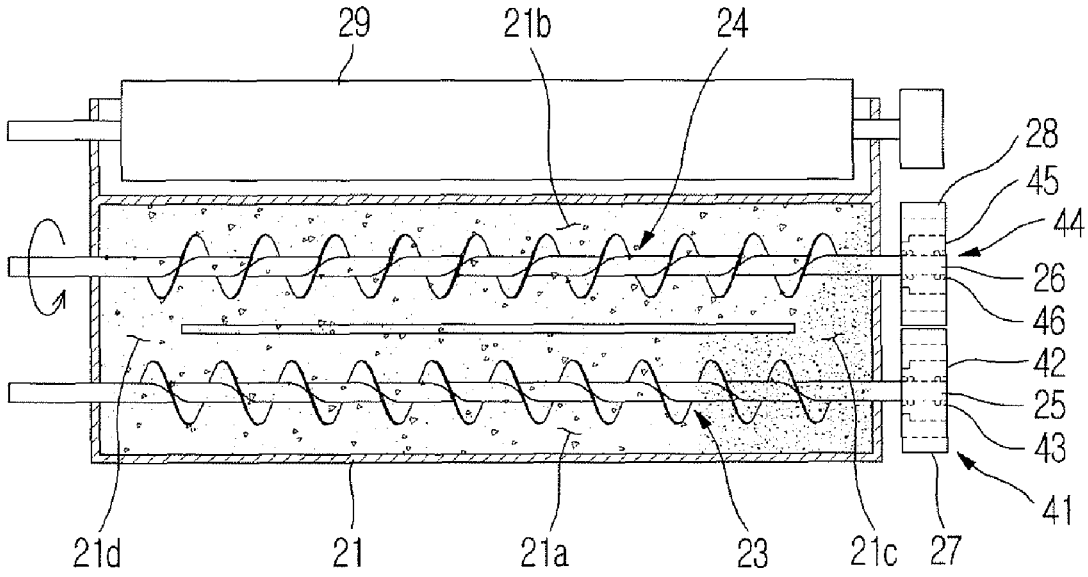

While the agitating auger 23 is in a stationary state, the supply auger 24 continuously rotates to transfer the developer concentrated on the first gate 21*c* in the supply space 21*b* toward the second gate 21*d*. If the developer concentrated on the first gate 21*c* is transferred by the operation of the supply auger 24, as illustrated in FIG. 5B, the developer concentrated on the first gate 21*c* in the agitating space 21*a* is transferred smoothly into the supply space 21*b* through the first gate 21*c*. Accordingly, the concentration phenomenon of the developer is solved.

If the developer is transferred smoothly through the first gate 21*c*, the rotational resistance and the torque of the agitating auger 23 decrease. If the torque of the agitating auger 23 decreases to an extent such that the torque applied to the inner ring 43 drops below the predetermined value, the inner ring 43 rotates together with the outer ring 42, so that the agitating auger 23 rotates again.

As described above, when the developer circulating in the agitating space 21*a* and the supply space 21*b* is concentrated on the gates 21*c* and 21*d* which form developer transfer passages between two spaces 21*a* and 21*b* and the flow resistance of the developer increases, the concentration phenomenon of the developer can be solved without applying an overload to the augers 23 and 24 which transfer the developer.

The concentration of the developer may be a density or amount of the developer disposed in a location within the inner space of the housing, for example, the agitating space 21*a*, the supply space 21*b*, the first gate 21*c*, or the second gate 21*d*.

Figure 6:
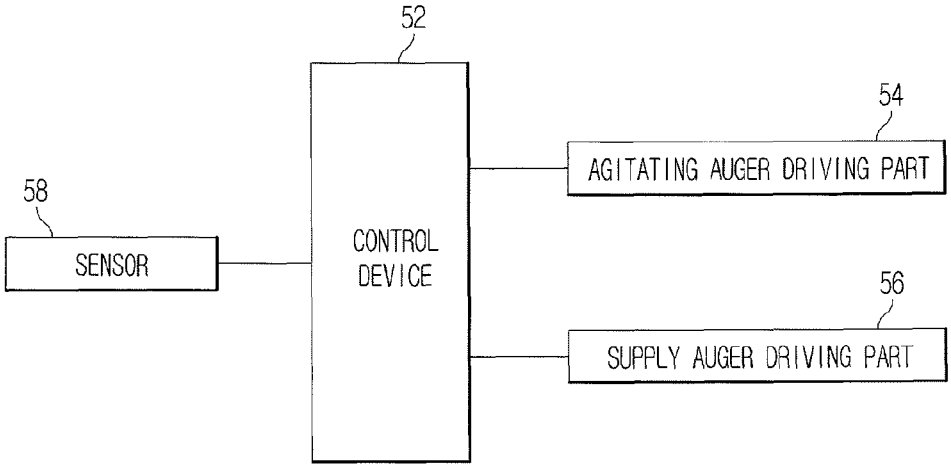
FIG. 6 is a block diagram illustrating an image forming apparatus in accordance with another exemplary embodiment of the present general inventive concept.
Figure 7:
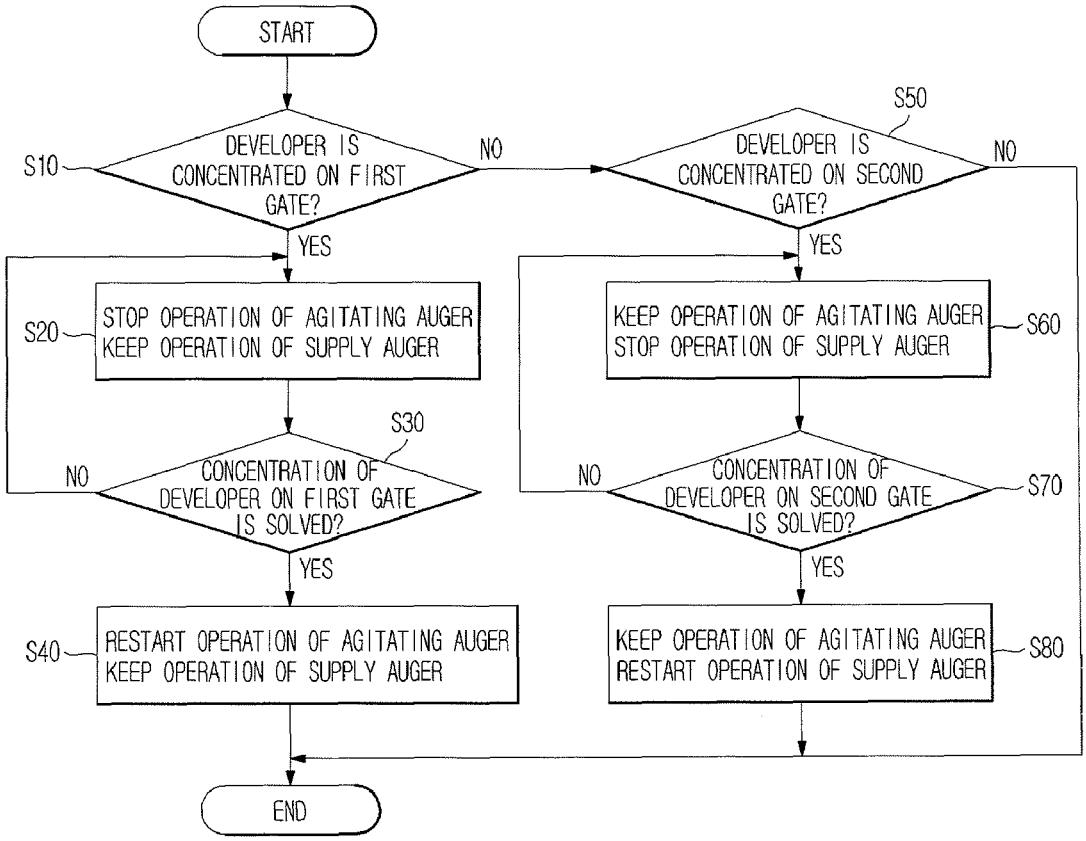
FIG. 7 is a flowchart illustrating a method of controlling a developing unit of an image forming apparatus in accordance with another exemplary embodiment of the present general inventive concept.

FIG. 6 is a block diagram illustrating an image forming apparatus in accordance with another exemplary embodiment of the present general inventive concept, and FIG. 7 is a flowchart illustrating a method of controlling a developing unit of an image forming apparatus in accordance with another exemplary embodiment of the present general inventive concept.

Hereinafter, the image forming apparatus in accordance with another exemplary embodiment of the present general inventive concept will be described with reference to FIGS. 6 and 7. Since the overall constitution of the image forming apparatus of this embodiment is the same as that of the image forming apparatus of the previous embodiment, the same components as the previous embodiment are denoted by the same reference numerals.

The image forming apparatus according to this embodiment has features of including a control device 52 which can interrupt the driving power transmitted to the agitating auger 23 or the supply auger 24 (without using a torque limiter as a rotation control means to control the rotation of the agitating auger 23 or the supply auger 24) when the developer in the housing 21 (see FIG. 4A) is concentrated on the first gate 21*c* or the second gate 21*d* and the torque of the agitating auger 23 or the supply auger 24 increases excessively.

The sensor 58 may be mounted in the agitating space 21*a* and/or the supply space 21*b*. It is possible that the sensor 58 is installed at a location in or adjacent to the first gate 21*c* and/or the second gate 21*d* to detect a difference of the developer in concentration, density, or amount at different locations within the inside of the housing 21 of the developing unit 20. The sensor 58 may be a conventional sensor to detect the developer.

In order that the control device 52 can interrupt the driving power transmitted to the agitating auger 23 or the supply auger 24, the image forming apparatus according to this embodiment is constituted such that the agitating auger 23 and the supply auger 24 receive the driving power through an agitating auger driving part 54 and a supply auger driving part 56, respectively, which are operated by the control device 52, and a sensor 58 is mounted to the housing 21 to detect the concentration of the developer. The agitating auger driving part 54 and the supply auger driving part 56 may be configured as different driving sources, or may be configured as a power transmission device (e.g., an electronic clutch) that can intermittently transmit the driving power from a single external driving source to the respective augers 23 and 24.

The method for controlling the developing unit of the image forming apparatus according to this embodiment will now be described with reference to FIG. 7.

As illustrated in FIG. 7, in response to the detecting signal from the sensor 58, the control device 52 determines whether the developer is concentrated on the first gate 21*c* of the developing unit 20 at operation S10, or determines whether the developer is concentrated on the second gate 21*d* of the developing unit 20 at operation S50. If it is determined that the developer is concentrated on the first gate 21*c*, the control device 52 controls the agitating auger driving part 54 to stop the operation of the agitating auger 23 at operation S20. At this time, the supply auger 24 continuously rotates to transfer the developer concentrated on the first gate 21*c* toward the second gate 21*d*. If the density of the developer near the first gate 21*c* is changed (i.e., decreases) due to the operation of the supply auger 24, the sensor 58 detects the density change of the developer, and generates the detecting signal corresponding thereto. In response to the detecting signal from the sensor 58, the control device 52 determines whether the concentration of the developer on the first gate 21*c* is solved at operation S30. If determining that the concentration of the developer on the first gate 21*c* is solved, the control device 52 controls the agitating auger driving part 54 to drive again the agitating auger 23 at operation S40.

Meanwhile, if determining that the developer is concentrated on the second gate 21*d*, the control device 52 controls the supply auger driving part 56 to stop the operation of the supply auger 24 at operation S60. At this time, the agitating auger 23 continuously rotates to transfer the developer concentrated on the second gate 21*d* toward the first gate 21*c*. If the density of the developer near the second gate 21*d* decreases due to the operation of the agitating auger 23, the sensor 58 detects the density change of the developer, and generates the detecting signal corresponding thereto. In response to the detecting signal from the sensor 58, the control device 52 determines whether the concentration of the developer on the second gate 21*d* is solved at operation S70. If determining that the concentration of the developer on the second gate 21*d* is solved, the control device 52 controls the supply auger driving part 56 to drive again the supply auger 24 at operation S80.

The sensor 58 may be configured as a sensor that directly detects a pressure of the developer at the first gate 21*c* and the second gate 21*d*, or may be configured as a sensor that indirectly senses the concentration of the developer on the first gate 21*c* and the second gate 21*d* by detecting a magnitude of the torque applied to the agitating auger 23 and the supply auger 24.

As apparent from the above description, when the developer does not circulate smoothly due to the concentration on the gates which connect the agitating space and the supply space in the housing of the developing unit and the load applied to the agitating auger or the supply auger increases excessively, the image forming apparatus according to the present invention can prevent an overload of the agitating auger or the supply auger and solve smoothly the concentration of the developer by adequately controlling the rotation of the agitating auger or the supply auger.

Although embodiments of the present general inventive concept have been shown and described, it would be appreciated by those skilled in the art that changes may be made in this embodiment without departing from the principles and spirit of the general inventive concept, the scope of which is defined in the claims and their equivalents.

What is claimed is:

1. An image forming apparatus comprising:

a photosensitive body on which an electrostatic latent image is formed;

a light scanning unit which scans a beam onto the photosensitive body;

a developing unit which includes a housing having an agitating space and a supply space to communicate with each other through two gates formed between the agitating space and the supply space to circulate a developer, an agitating auger rotatably mounted in the agitating space to transfer the developer, a supply auger rotatably mounted in the supply space to transfer the developer, and a magnetic roller which receives the developer by the supply auger and attaches the developer to the photosensitive body;

a rotation control unit which controls rotation of the agitating auger and the supply auger; and a transfer unit which transfers a visible image formed on the photosensitive body onto a printing medium, wherein when the developer is concentrated in one of two gates, the rotation unit controls one of the agitating auger and the supply auger, which is positioned on a downstream side of the gate in which the developer is concentrated, to temporarily stop rotating, and the developer concentrated in the gate is transferred from the gate by the other one of the agitating auger and the supply auger, which is positioned on an upstream side of the gate in which the developer is concentrated.

2. The image forming apparatus according to claim 1, wherein:

the agitating auger and the supply auger respectively have rotating shafts respectively provided with gears connected to an external driving source;

the rotation control unit comprises torque limiters which are mounted between the rotating shafts of the agitating auger and the supply auger and the gears; and if a torque applied to the rotating shafts exceeds a predetermined value, the torque limiters interrupt power transmission between the rotating shafts and the gears.

3. The image forming apparatus according to claim 2, wherein:

each of the torque limiters includes an outer ring which is coupled to each of the gears, and an inner ring which is coupled to each of the rotating shafts of the agitating auger and the supply auger and is in contact with an inner surface of the outer ring, the inner ring being able to slip on the inner surface of the outer ring; and if a torque applied to the inner ring exceeds a predetermined value, the inner ring slips on the inner surface of the outer ring, and the inner ring and the rotating shaft stop rotating.

4. The image forming apparatus according to claim 1, wherein:

the agitating auger and the supply auger respectively have rotating shafts respectively coupled with gears connected to an external driving source; and the rotation control unit includes auger driving parts which transmit driving power to the rotating shafts of the agitating auger and the supply auger, and a control device which controls the auger driving parts.

5. The image forming apparatus according to claim 4, further comprising:

a sensor to sense concentration of the developer in the housing.

6. A developing unit of an image forming apparatus, comprising:

a housing which has an agitating space and a supply space to communicate with each other through two gates to circulate a developer;

an agitating auger which is rotatably mounted in the agitating space to transfer the developer;

a supply auger which is rotatably mounted in the supply space to transfer the developer;

a magnetic roller which receives the developer by the supply auger and adheres the developer to a photosensitive body; and a rotation control unit which controls rotation of the agitating auger and the supply auger, wherein when the developer is concentrated in one of the two gates, the rotation control unit controls one of the agitating auger and the supply auger, which is positioned on a downstream side of the gate in which the developer is concentrated, to temporarily stop rotating, and the developer concentrated in the gate is transferred from the gate by the other one of the agitating auger and the supply auger, which is positioned on an upstream side of the gate in which the developer is concentrated.

7. The developing unit according to claim 6, wherein:

the agitating auger and the supply auger respectively have rotating shafts, the rotating shafts being respectively provided with gears connected to an external driving source;

the rotation control unit is configured as torque limiters which are mounted between the rotating shafts of the agitating auger and the supply auger and the gears; and if a torque applied to the rotating shafts exceeds a predetermined value, the torque limiters interrupt power transmission between the rotating shafts and the gears.

8. The developing unit according to claim 7, wherein:

each of the torque limiters includes an outer ring which is coupled to each of the gears, and an inner ring which is coupled to each of the rotating shafts of the agitating auger and the supply auger and is in contact with an inner surface of the outer ring, the inner ring being able to slip on the inner surface of the outer ring; and if a torque applied to the inner ring exceeds a predetermined value, the inner ring slips on the inner surface of the outer ring, and the inner ring and the rotating shaft stop rotating.

9. The developing unit according to claim 6, further comprising:

a sensor disposed near at least one of the two gates to detect a difference in concentration, density, or amount of the developer between different locations within the housing, wherein information from the sensor is used to determine whether the developer is concentrated in any one of the two gates.

10. The developing unit according to claim 6, wherein the agitating auger and the supply auger are configured to move a binary developer including a toner particle and a magnetic carrier.

11. A method of controlling a developing unit of an image forming apparatus, comprising:

determining whether a developer contained in a housing having an agitating space and a supply space is concentrated in one of two gates which connect the agitating space and the supply space to circulate the developer;

if the developer is concentrated in one of the two gates in the housing, stopping rotation of one of an agitating auger and a supply auger rotatably mounted in the agitating space and the supply space, which is positioned on a downstream side of the gate in which the developer is concentrated, to transfer the developer from the gate on which the developer is concentrated by the other one of the agitating auger and the supply auger, which is positioned on an upstream side of the gate in which the developer is concentrated;

determining whether the concentration of the developer on the gate is solved; and if the concentration of the developer on the gate is solved, rotating again one of the agitating auger and the supply auger, which was stopped from rotating.

12. A developing unit usable with an image forming apparatus, comprising:

a housing including an agitating space and a supply space to contain a developer;

a supply auger disposed in the supply space to selectively rotate according to an amount of a developer;

an agitating auger disposed in the agitating space to selectively rotate according to an amount of the developer; and at least one torque limiter to selectively transmit a driving power of an external driving source to one of the supply auger and the agitating auger according to the amount of the developer.

13. The developing unit according to claim 12, wherein one of the supply auger and the agitating auger is stationary with respect to the other one of the supply auger and the agitating auger according to a density representing the amount of the developer in one of the supply space and the agitating space.

14. The developing unit according to claim 12, wherein the developer moves between the supply space and the agitating space according to a selectively rotating one of the supply auger and the agitating auger.

15. The developing unit according to claim 12, wherein the housing comprises a partition to divide an inside space into the agitating space and the supply space, and to form a first gate and a second gate to connect the agitating space and the supply space such that the developer moves between the agitating space and the supply space.

16. The developing unit according to claim 15, wherein one of the supply auger and the agitating auger selectively stops according to an amount of the developer accumulating in one of the first gate and the second gate, such that the other one of the supply auger and the agitating auger rotates to move the developer between the first gate and the second gate.

17. The developing unit according to claim 15, wherein the first gate and the second gate are spaced apart from a center of an inside of the housing, and lengths of the supply auger and the agitating auger are longer than a distance betweeh the first gate and the second gate.

18. The developing unit according to claim 12, further comprising:

a supply gear to receive an external rotating force;

a supply shaft connected to the supply auger to selectively idle with respect to the gear according to a torque applied to the supply shaft;

an agitating gear to receive an external rotating force; and an agitating shaft connected to the supply auger to selectively idle with respect to the gear according to a torque applied to the agitating shaft.

19. The developing unit according to claim 18, further comprising:

a torque limiter disposed between the supply gear and the supply shaft to allow the supply gear to idle with respect to the supply shaft.

20. The developing unit according to claim 18, further comprising:

a torque limiter disposed between the agitating gear and the agitating shaft to allow the agitating gear to idle with respect to the agitating shaft.

21. The developing unit according to claim 18, further comprising:

a first torque limiter disposed between the supply gear and the supply shaft, and having a first torque limiting value to allow the supply gear to idle with respect to the supply shaft; and a second torque limiter disposed between the agitating gear and the agitating shaft, and having a second torque limiting value to allow the agitating gear to idle with respect to the agitating shaft.

22. The developing unit according to claim 12, further comprising:

a roller disposed in the supply space to transfer the developer from the supply auger to a photosensitive body, wherein one of the supply auger and the agitating auger selectively stops rotating according to the amount of the developer in one of the supply space and the agitating space when the roller supplies the developer from the supply space to the photosensitive body.

* * * * *